United States Patent [19]

Squire

[11] Patent Number: 4,751,885

[45] Date of Patent: Jun. 21, 1988

[54] SECURITY SAFE

[76] Inventor: Ronald A. Squire, 75 Liverpool Road, Burwood Heights, New South Wales 2136, Australia

[21] Appl. No.: 907,047

[22] Filed: Sep. 12, 1986

[51] Int. Cl.[4] ..... E05G 1/04

[52] U.S. Cl. ..... 109/51; 312/238; 52/288

[58] Field of Search ..... 109/50–52; 52/288; 40/152.1; 312/198, 238

[56] References Cited

U.S. PATENT DOCUMENTS

| | | | |
|---|---|---|---|
| 368,877 | 8/1887 | Dake | 109/51 |
| 702,883 | 6/1902 | Peckham | 109/51 |
| 727,105 | 5/1903 | Dodson | 109/51 |
| 1,404,480 | 1/1922 | Rauwald et al. | 109/50 |
| 2,991,577 | 7/1961 | Bellocchio | 40/152.1 |
| 3,257,154 | 6/1966 | Lewis | 312/238 |

FOREIGN PATENT DOCUMENTS

| | | | |
|---|---|---|---|
| 148984 | 11/1952 | Australia . | |
| 714731/81 | 6/1981 | Australia . | |
| 73057/81 | 7/1981 | Australia . | |
| 347853 | 5/1931 | United Kingdom | 109/51 |

OTHER PUBLICATIONS

Three sheets of drawings supplied by inventor relating to Australian Design, Pat. No.: 40592/85 and to Great Britian Design Application No.: 1032777.

*Primary Examiner*—Neill Wilson

*Attorney, Agent, or Firm*—Perman & Green

[57] ABSTRACT

The present invention discloses both a security safe able to be mounted in the corner of a room and a method of securing such a safe. The safe is formed from three planar panels which are substantially mutually orthogonal and from two walls and a base. A front extends between the walls and base and faces the corner formed by the intersection of the walls and base. The front includes an opening with a lockable door. The safe is installed with its corner nestled into the corner of a room and a corresponding fastener is passed from the interior of the safe through each of the three safe panels into the walls and floor of the room.

22 Claims, 2 Drawing Sheets

Figure 1:
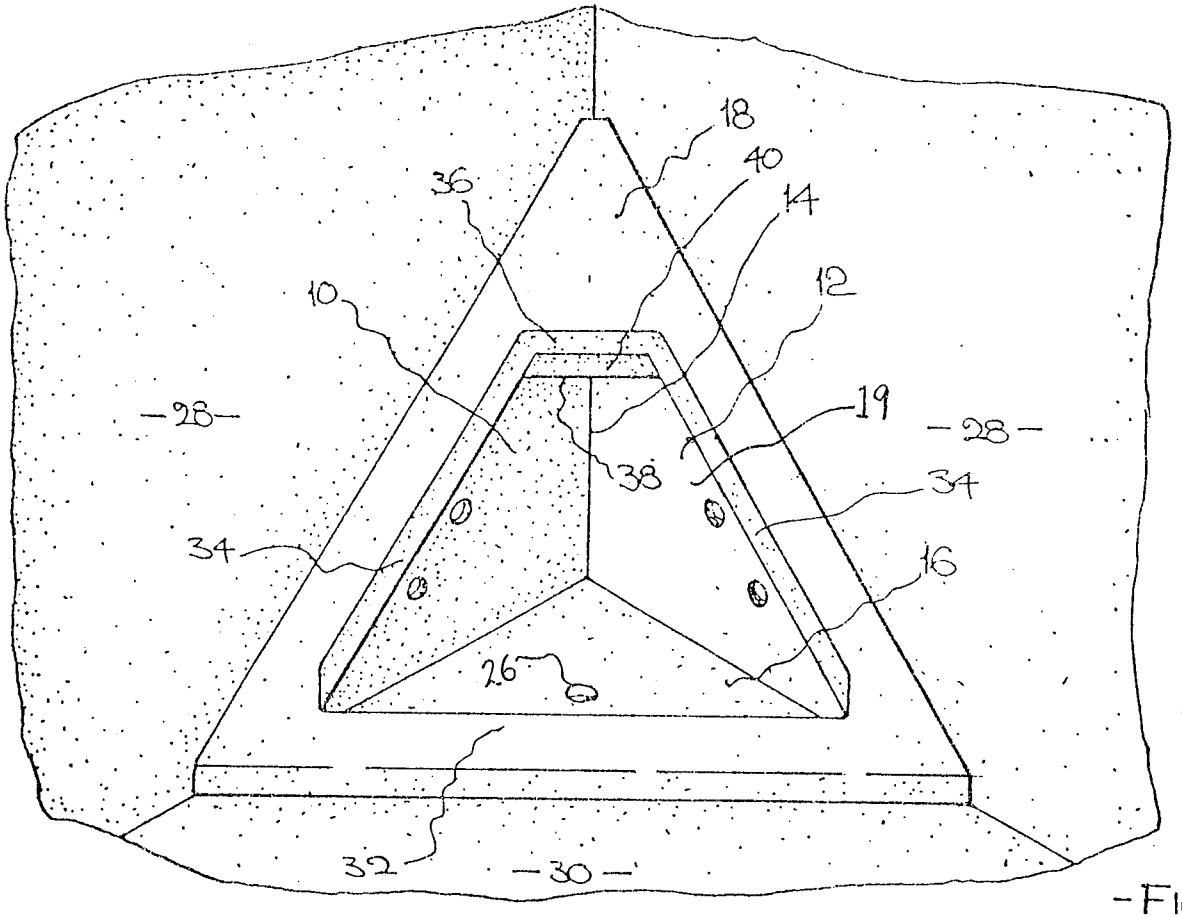

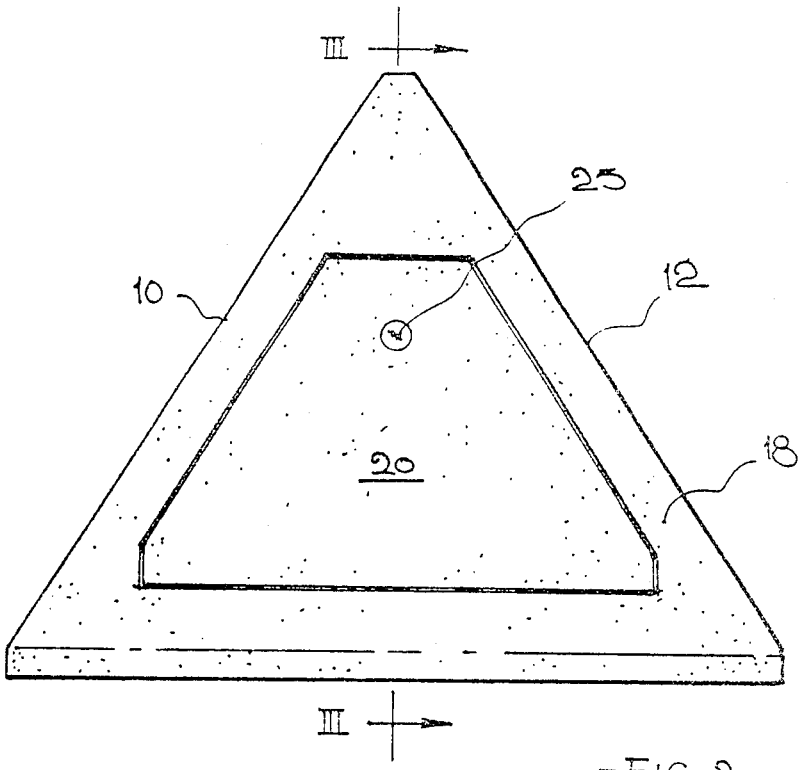
-FIG. 2-
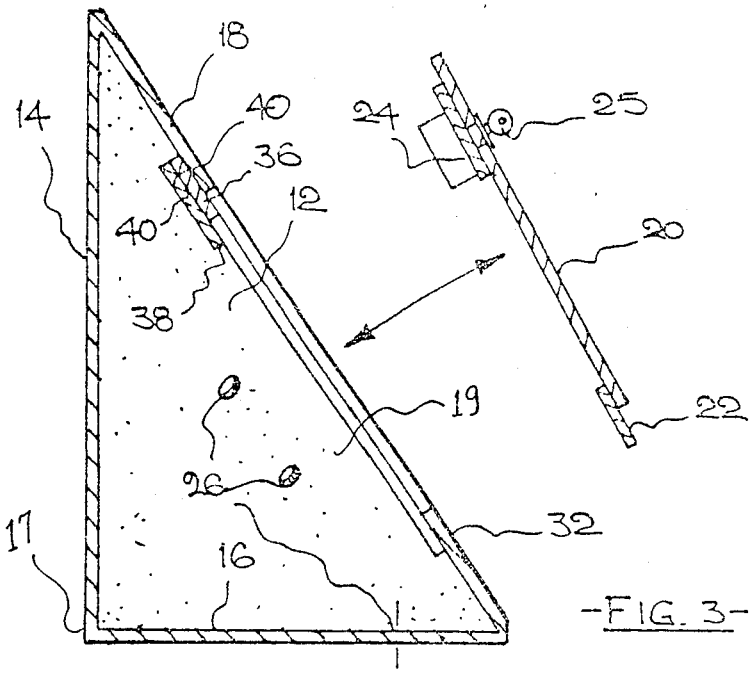
-FIG. 3-

SECURITY SAFE

The present invention relates to a security safe and, in particular, to a security safe able to be releasably secured into the corner of a building or structure. A method of securing such a safe is also disclosed.

Conventional safes which are fitted into a wall or floor and have a flat front surface which is substantially flush with the surface of the wall or floor, suffer from a number of disadvantages. In particular, the material of the wall or floor immediately around the safe can be readily crumbled and the safe removed. Alternatively, a hacksaw blade can be slid into the gap between the wall of the safe and the wall or floor, and in this way any restraining bolts can be sawed through. Furthermore, in many instances, the box-like structure of the safe means the safe is not strong and therefore is able to be bowed, buckled, or otherwise collapsed inwardly by use of a battering-ram or like device.

It is the object of the present invention to substantially overcome or ameliorate the abovementioned disadvantages by the provision of a security safe which can be fitted into the corner of a building or structure. A further object is the provision of a method of securing such a safe so as to make the removal of the safe, or the gaining of access into the interior of the safe, extremely difficult.

According to one aspect of the present invention there is disclosed a security safe comprising three panels which form two walls and a base which are substantially planar and substantially mutually orthogonal, and a front extending between said walls and base and facing the corner formed by the intersection of said walls and base; said front having an opening therein having means to releasably close said opening and said safe being able to be secured with said safe corner nesting into a corner of a building or structure formed from three substantially mutually orthogonal planar surfaces by means of fastener(s) extending between the panel(s) and the corresponding surface(s) of said building or structure.

According to another aspect of the present invention there is disclosed a method of securing a security safe having three panels which form two walls and a base which are substantially planar and substantially mutually orthogonal, the intersection of said walls and base forming a corner of said safe, said method comprising the steps of nesting said safe corner in the corner of a building or structure formed from three substantially mutually orthogonal planar surfaces; and extending a fastener between each of said panels and the corresponding surface.

A preferred embodiment of the present invention will now be described with reference to the drawings in which:

FIG. 1 is a front perspective view of the safe of the preferred embodiment with the hatchcover removed, FIG. 2 is a view similar to FIG. 1 but showing the safe with the hatchcover installed, and FIG. 3 is an exploded cross-sectional view along the lines III—III of FIG. 2.

As seen in the drawings, the safe of the preferred embodiment is formed from a generally triangular left-side wall 10, a generally triangular right-side wall 12, and a generally triangular base 16. The walls 10,12 and the base 16 are substantially planar and are also substantially mutually orthogonal and meet to form a corner 17.

The safe is provided with a front panel 18 which is substantially flat and of generally triangular configuration and extends between the edges of the walls 10, 12 and base 16 furthest from the corner 17. The front panel 18 is also provided with a hatch 19 of generally triangular configuration which provides an access opening for the interior of the safe.

As seen in FIGS. 2 and 3, the safe is also provided with a removable hatch cover 20 which is shaped to mate with the hatch 19. The hatchcover 20 has a lower flange 22 located interior thereof and extending beyond the hatchcover 20. Opposite the flange 22, and also interior of the hatchcover 20, is a lock 24 which is provided with a key 25 insertable into the lock 24 from the exterior of the hatchcover 20.

As best seen in FIGS. 1 and 3, the hatch 19 is provided with a hatchcover support having side portions 34 and a top portion 36. Extending across the upper portion of the hatch 19 is a crossbar 40.

It will be apparent, that in order to engage the hatchcover 20 with the hatch 19, with the lock 24 undone, the flange 22 of the cover 20 is inserted into the hatch 19 so as to mate with the lower rim 32 of the front panel 18. The cover 20 is then able to be pivoted about the lower rim 32 in order that the hatchcover 20 completely covers the hatch 19. Then the lock 24 is operated in conventional manner by the key 25 so that a tongue (not illustrated) of the lock 24 extends behind the crossbar 40. In this condition, the hatchcover 20 is securely located within, and completely closes off, the hatch 19. The hatchcover 20 cannot be removed without the key 25 since the tongue of the lock 24 and the flange 22 firmly locate the lock 20 in position.

The safe is secured in position in the corner of a building formed by a pair of intersecting walls 28 and a floor 30. The corner 17 of the safe is nested into the corner of the building as illustrated in FIG. 1 so as to abutt the apertures 26 in the walls 10, 12 and base 16 against the corresponding walls 28 and floor 30. In this position, corresponding blind holes can be drilled in the walls 28 and floor 30 and a masonry bolt (not illustrated) passed through the aperture 26 and into the holes to secure the safe in position.

It will be apparent that the above described arrangement has a number of significant features. Once bolted into place, it cannot be removed without substantially demolishing the walls 28 and floor 30 forming the corner of the building or structure. However, should the owner of the safe wish to re-locate the safe (because the owner moves house for example) then the safe can be easily removed by first unlocking the hatchcover 20 with the key 25, and then unscrewing the nut of each masonry bolt.

However, when the safe has been fixed into the corner illustrated in FIG. 1, and the hatch 19 is closed by the hatchcover 20, there is no access to the masonry bolts or their nuts so that the safe cannot be removed without demolishing the walls 28 and floor 30.

Furthermore, it will be appreciated that this advantage is able to be achieved without the need for the safe to be fixed within a large size opening in any wall. No elaborate bricklaying or other masonry work is required and the surfaces of the walls 28 and floor 30 can be easily made good after the safe has been removed.

In addition, the safe does not protrude from the reverse side of the wall thereby providing both an aesthetic advantage and also making it very difficult for the safe to be attacked from the exterior of the building or even from the next room.

A still further advantage of the above described arrangement is that the triangular front panel 18 is very resistant to attack by means of a battery-ram, or like implement, since any force applied to the front panel 18 is immediately distributed to the walls 10, 12 and base 16. This is to be contrasted with a conventional box shaped, or cubic, safe in which one corner may be caved inwardly, thereby often springing the door open (either inwardly or outwardly). This is especially the case since the safe of the preferred embodiment is made from ⅜ inch thick hardened high tensile steel plates which are welded together. Moreover, because the hatchcover 20 overlies the hatch 19 and the associated hatchcover support, the hatchcover 20 is extremely resistant to attack by jemmy, lever, wedge or hammer.

The foregoing describes only one embodiment of the present invention and modifications, obvious to those skilled in the art, can be made thereto without departing from the scope of the present invention. For example, the safe of the present invention can be secured into a corner formed from two walls and the ceiling of a building, rather than two walls and the floor of the building as illustrated.

What I claim is:

1. A security safe designed to be fastened in nested position within an orthogonal corner of a building or structure, comprising three panels which form two walls and a base which are substantially planar and substantially mutually orthogonal, and a front extending between said walls and base and facing the corner formed by the intersection of said walls and base; said front having an opening and therein having means to releasably close said opening said safe being able to be secured with said safe corner nesting into an orthogonal corner of a building or structure formed from three substantially mutually orthogonal planar surfaces by means of fastener(s) extending between the panel(s) and the corresponding surface(s) of said building or structure which are parallel to and contact and shield each of said panels when said safe is in said nested position.

2. A safe as claimed in claim 1 wherein said front is substantially flat.

3. A safe as claimed in claim 2 wherein each of said panels and front is substantially triangular.

4. A safe as claimed in claim 3 wherein said means to releasably close said opening comprises a cover.

5. A safe as claimed in claim 4 wherein said cover includes a flange engageable with one interior portion of the rim of said opening and a lock having a retractable portion engageable with an opposite interior portion of said rim.

6. A safe as claimed in claim 5 wherein said lock is operatable by a key insertable therein from the exterior of said cover.

7. A safe as claimed in claim 6 wherein said opening and cover are of a generally triangular configuration.

8. A safe as claimed in claim 7 wherein each of said three panels includes at least one aperture adapted to receive a fastener.

9. A safe as claimed in claim 1 wherein each of said three panels includes at least one aperture adapted to receive a fastener.

10. A safe as claimed in claim 1 wherein said means to releasably close said opening comprises a cover.

11. A safe as claimed in claim 2 wherein said means to releasably close said opening comprises a cover.

12. A safe as claimed in claim 4 wherein said opening and said cover are of generally triangular configuration.

13. A safe as claimed in claim 5 wherein said opening and said cover are of generally triangular configuration.

14. A safe as claimed in claim 3 wherein each of said three panels includes at least one aperture adapted to receive a fastener.

15. A safe as claimed in claim 4 wherein each of said three panels includes at least one aperture adapted to receive a fastener.

16. A safe as claimed in claim 5 wherein each of said three panels includes at least one aperture adapted to receive a fastener.

17. A security safe comprising three panels which form two walls and a base which are substantially planar and substantially mutually orthogonal, and a front extending between said walls and base and facing the corner formed by the intersection of said walls and base; said front having an opening therein having a cover to releasably close said opening, said cover including a flange engageable with one interior portion of the rim of said opening and a lock having a retractable portion engageable with an opposite interior portion of said rim and said safe being able to be secured with said safe corner nesting into a corner of a building or structure formed from three substantially mutually orthogonal planar surfaces by means of fastener(s) extending between the panel(s) and the corresponding surface(s) of said building or structure.

18. A safe as claimed in claim 17 wherein said front is substantially flat.

19. A safe as claimed in claim 17 wherein each of said panels and front is substantially triangular in shape.

20. A safe as claimed in claim 17 wherein said lock is operatable by a key insertable therein from the exterior of said cover.

21. A safe as claimed in claim 17 wherein said opening and cover are of generally triangular configuration.

22. A safe as claimed in claim 17 wherein each of said three panels includes at least one aperture adapted to receive a fastener.

* * * * *